US008376177B2

(12) United States Patent
Castner et al.

(10) Patent No.: US 8,376,177 B2
(45) Date of Patent: Feb. 19, 2013

(54) CONTAINER HAVING SEALABLE DISCRETE COMPARTMENTS

(75) Inventors: Huntley C. Castner, Manhattan Beach, CA (US); Kimberly D. Castner, Manhattan Beach, CA (US); Hinman Dunn, Redondo Beach, CA (US); Hui Wang, Ningbo (CN)

(73) Assignee: Go Green Lunch Box LLC, Manhattan Beach, CA (US)

( * ) Notice: Subject to any disclaimer, the term of this patent is extended or adjusted under 35 U.S.C. 154(b) by 261 days.

(21) Appl. No.: 12/751,060

(22) Filed: Mar. 31, 2010

(65) Prior Publication Data

US 2011/0240653 A1 Oct. 6, 2011

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 220/526; 206/561

(58) Field of Classification Search ..... 220/526, 220/521, 788, 326, 315, 233, 235, 234, 254.1, 220/254.7, 293, 200, 502, 537, 538, 539, 220/540; 206/1.5, 561

See application file for complete search history.

(56) References Cited

U.S. PATENT DOCUMENTS

| | | | | |
|---|---|---|---|---|
| 3,234,107 | A * | 2/1966 | Kaufman et al. | 435/288.4 |
| 6,131,760 | A * | 10/2000 | Huang | 220/526 |
| 6,766,918 | B1 | 7/2004 | Bogdanovich | |
| 6,883,546 | B1 * | 4/2005 | Kobylinski | 138/89 |
| 7,114,630 | B2 | 10/2006 | Dege et al. | |
| 7,326,428 | B2 | 2/2008 | Weir | |
| 2006/0201950 | A1 * | 9/2006 | Liu | 220/526 |
| 2008/0110911 | A1 * | 5/2008 | Chen | 220/788 |
| 2009/0206090 | A1 * | 8/2009 | Hanson et al. | 220/526 |

OTHER PUBLICATIONS

U.S. Appl. No. 61/124,514, filed Apr. 18, 2008, Castner, et al.

* cited by examiner

*Primary Examiner* — Mickey Yu
*Assistant Examiner* — Rafael Ortiz
(74) *Attorney, Agent, or Firm* — Connolly Bove Lodge & Hutz LLP

(57) ABSTRACT

A container having a bottom section having a plurality of discrete compartments which may be sealed to prevent spilling or intermixing of contents including liquids in the compartments, sealing is accomplished by a lid having ribs, each of which is dimensioned to fit within the top portion of a compartment. A rib of resilient material surrounds each rib and is compressed when the lid is affixed to the bottom section. The lid carries a locking mechanism which when in the close position urges the central part of the lid toward the bottom section.

1 Claim, 6 Drawing Sheets

CONTAINER HAVING SEALABLE DISCRETE COMPARTMENTS

BACKGROUND OF THE INVENTION

1. Field of the Invention

The present invention relates to containers and more particularly to a molded plastic container which includes a plurality of discrete compartments each of which can be sealed one from the other. More specifically, the present invention is directed to a lunch box having leak proof sealable discrete compartments within which various food items can be stored and will not spill or mingle and which lunch box may be reused indefinitely.

2. Description of Prior Art

Containers having a plurality of compartments which can be sealed by placing a lid thereon and latching the lid in place are well known in the prior art. The fact that such containers can be utilized as lunch boxes is also well known. Such devices are shown for example in U.S. Pat. Nos. 6,131,760; 7,114,630; 6,766,918; 7,326,428 and Patent Publications 2006/0201950 and 2008/0110911. The devices of a type shown in the prior art and above referred to, however, have the disadvantage that the seal which is provided to isolate the discrete compartments does not always function effectively over the long term. These devices are manufactured utilizing plastic materials and as the plastic ages it tends to warp and as it warps the seal looses its effectiveness, thus allowing the food disposed in the various compartments to spill and intermix.

It has also been found that the material utilized to provide the seal in the containers of the prior art does not always function to provide the desired seals.

There is thus a need for a container having a plurality of discrete compartments each of which can be sealed to prevent liquid or wet food from leaking between the compartments and that will retain the seal between the various compartments over a long period of time thereby allowing the container to be reused for indefinite periods of time.

SUMMARY OF INVENTION

The present invention is a container which includes a bottom section having a plurality of discrete compartments and a lid having a plurality of discrete downwardly extending spaced apart ribs each of which is dimensioned to be received within one of the compartments, a ring of resilient material is disposed within a channel surrounding each of the spaced apart ribs, means is disposed on the periphery of the lid for securing the lid to the bottom section to engage the resilient material to seal each of the discrete compartments and means carried by the lid and disposed inwardly from the periphery of the lid and engaging the bottom section for urging the lid to a first position toward the compartments for locking the lid in the first position and securing the seal across the container.

DETAILED DESCRIPTION

Figure 1:
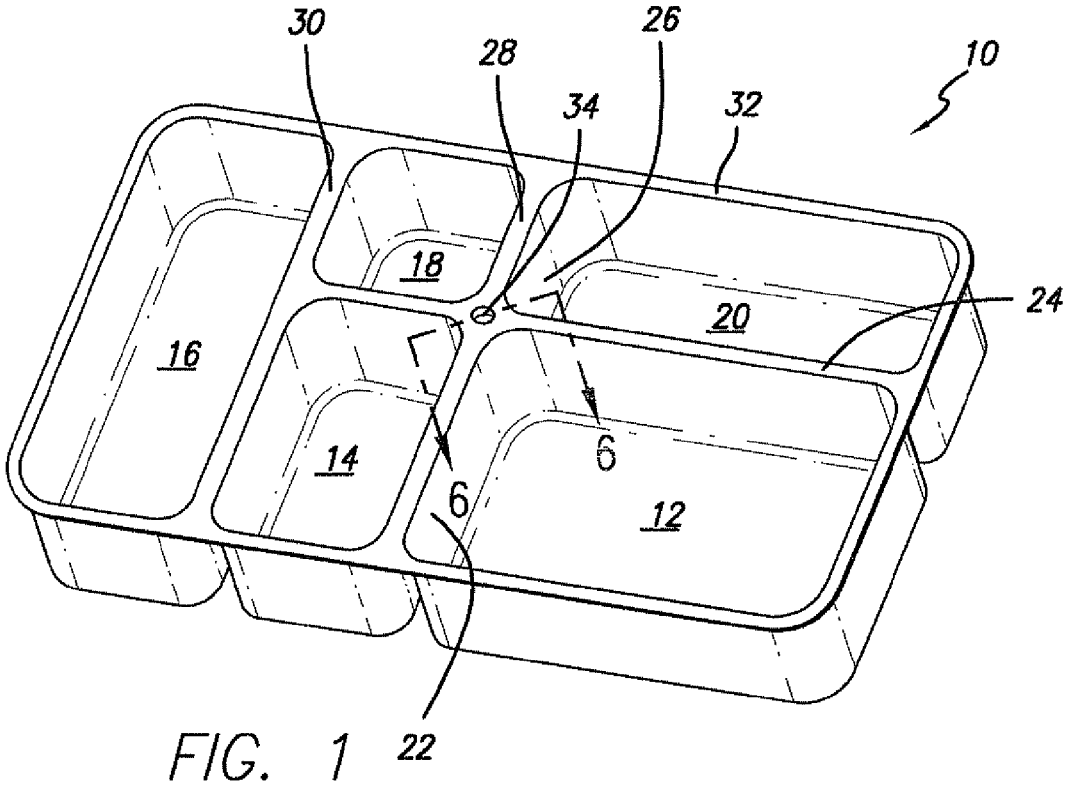
FIG. 1 is a perspective view of the top of the bottom section without a lid contained thereon.
Figure 2:
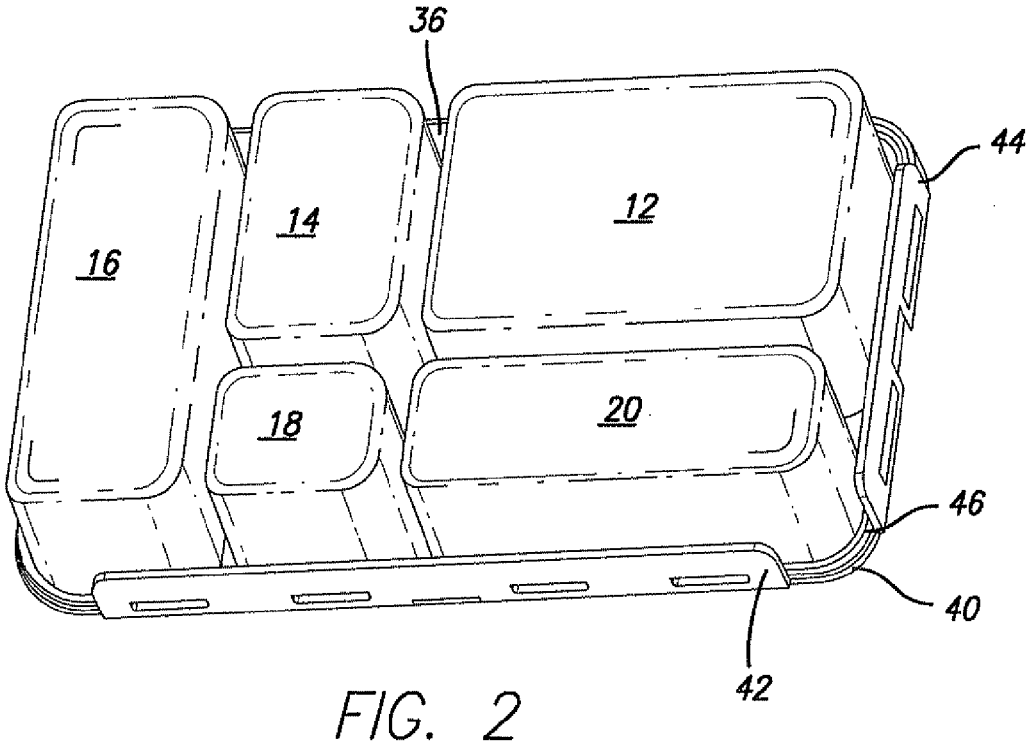
FIG. 2 is a perspective view of the bottom of the bottom section with a lid secured thereto.

Referring now to the drawings and more particularly to FIGS. 1 and 2 thereof, there is illustrated the bottom section 10 of a molded plastic container constructed in accordance with the principles of the present invention. As is shown in FIG. 1, the container 10 includes a plurality of discrete compartments 12, 14, 16, 18 and 20. Each of the compartments is defined by a continuous wall such as the wall 22 which defines the discrete compartment 12. The continuous wall has an upper rim terminating in a flat area 24 which encircles the compartment 12. The flat area is defined by for example, the continuous wall 22 of the compartment 12 terminating at its upper section along with a wall 26 of the compartment 20 and merging continuously with the upper rim of the continuous wall 22 thereby providing the elongated flat surface 24. As can be seen, in FIG. 1 there thus provided a plurality of flat surfaces which intersect each other such as a flat surface 28 and the flat surface 30 as well as the flat rim 32 that surrounds the bottom section 10. It should be noted that at the intersection between the flat areas 24 and 28 there is provided an opening 34 which will be described more in detail in conjunction with FIG. 6.

Figure 2A:
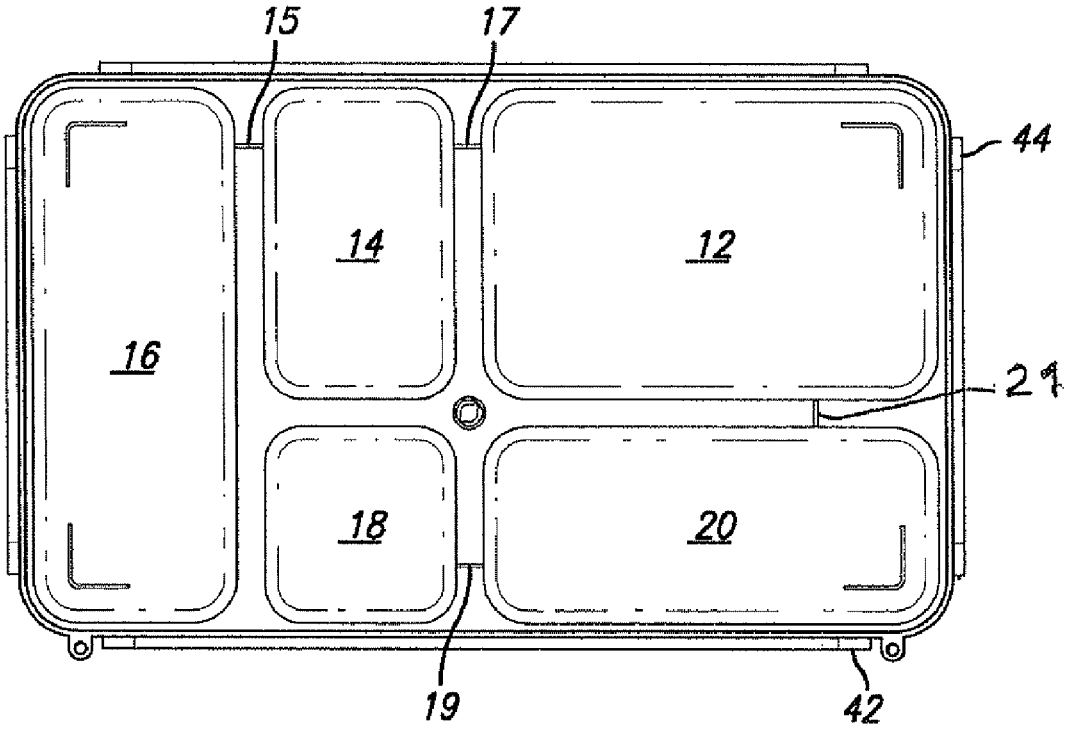

As is clearly seen in FIGS. 2 and 2A, each of the discrete compartments 12, 14, 16, 18 and 20 is formed separately so that there is provided a space between the walls of each of the compartments as is illustrated at 36 between the opposed walls of the compartments 12 and 14. This spacing is the result of the discrete compartments having continuous walls and allow for the formation of rounded corners to facilitate cleaning. Separators or stiffeners such as shown at 15, 17, 19 and 21 are provided in the form of a web like structure which extends from the flat surface such as shown at 24, 28 and 30 downwardly for a short distance in the space between the walls and engages the opposed continuous walls of adjacent discrete compartments. For example the separator 15 engages the opposed walls of compartments 14 and 16, the separator 17 engages the opposed walls of compartments 12 and 14, the separator 19 engages the opposed walls of the compartments 18 and 20, and the separator 21 engages the opposed walls of compartments 12 and 20. These separators provide structural support to minimize flexing of the bottom, that is, without the separators one could move (slightly rotate) a compartment, such as 16, about the member forming the flat surface 30. As is also illustrated in FIG. 2, the bottom section 10 has a lid 40 affixed thereto. The lid has a plurality of fastening flanges disposed peripherally on all four sides, two of which are shown at 42 and 44. These fastening flanges each has a plurality of latch portions (not shown) which engage the lower portion 46 of the rim 32 of the bottom section thereby applying pressure and securing the lid 40 along all four sides to the bottom section 10.

Figure 3:
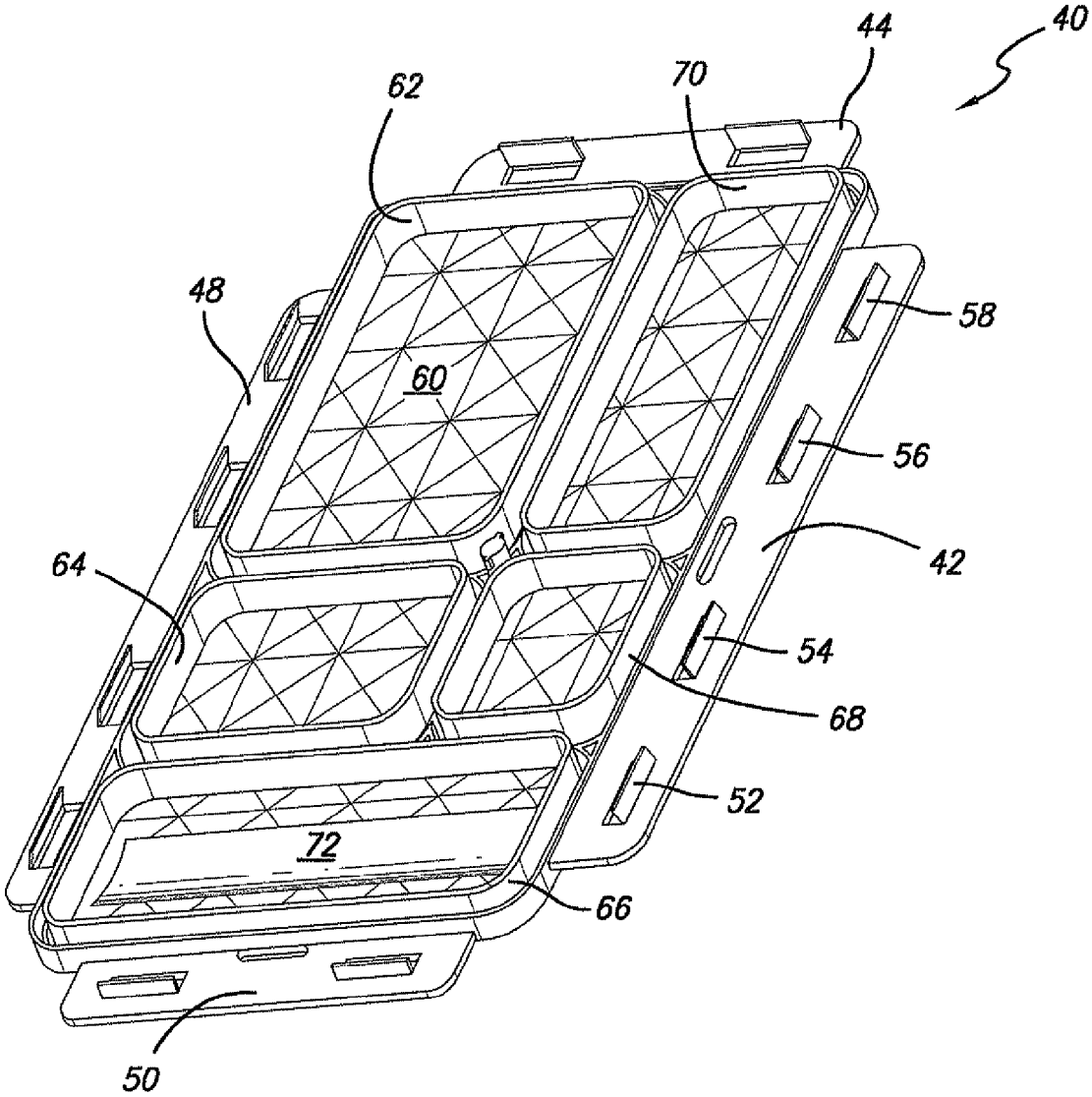
FIG. 3 is a perspective view of the inside of the lid.

The structure of the lid 40 is shown more in detail in FIG. 3 to which reference is hereby made. As is therein shown, there are four fastening flanges 42, 44, 48 and 50 which are attached to the body of the lid by plastic material which functions as a hinge. As is illustrated, each of the fastening flanges includes a plurality of latch portions, for example, as shown at 52, 54, 56 and 58 with regard to the fastening flange 42. Similar latch portions are contained on each of the fastening flanges 44, 48 and 50. As above indicated, the latch portions protruding from the fastening flanges are constructed such that as the fastening flanges are rotated from the position shown in FIG. 3 to the position shown in FIG. 2, the latch portions slide over and engage the bottom portion 46 of the rim 32 of the bottom section 10 thereby securely fastening the lid 40 to the bottom section 10. As is shown in FIG. 3, the lid 40 has an inner wall 60. The inner wall 60 has a plurality of discrete downwardly extending spaced apart ribs thereon as shown at 62, 64, 66, 68 and 70. Each of these ribs is dimensioned to be received within the upper rim of one of the plurality of compartments 12-20 as shown in FIG. 1. For example, the downwardly extending rib 62 is dimensioned to fit internally within the upper rim defined by the continuous wall 22 of the compartment 12. Similarly the wall 64 would fit within the compartment 14, the rib 66 within the compartment 16, the rib 68 within the compartment 18 and the rib 70 within the compartment 20.

The lid 40 is constructed such that a plurality of very shallow pyramids are formed protruding outwardly from the top surface of the lid such that the bases of the pyramids are at the inner wall 60. Thus, on the inner wall 60 the walls of the pyramid are extending away from the plane of the wall 60 and such is depicted by the crossed lines shown in FIG. 4. Also within the area surrounded by the downwardly extending rib 66 there is a concave area 72, which causes the outer surface of the lid to have an outwardly extending convex surface. The pyramids and the convex surface referred to above provide rigidity to the lid as do the downwardly extending ribs 62-70. By providing this rigidity to the lid more effective sealing of the discrete compartments is effected and warping of the lid over time is minimized.

Figure 4:
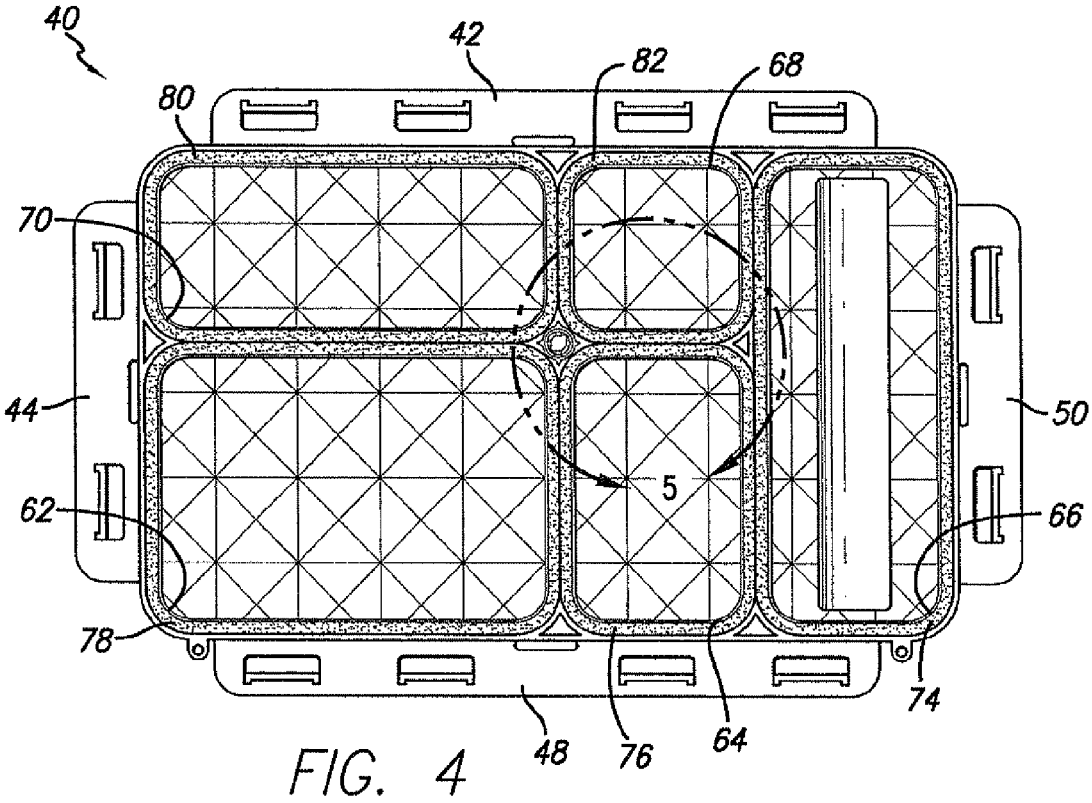
FIG. 4 is a plan view of the inside of the lid.
Figure 5:
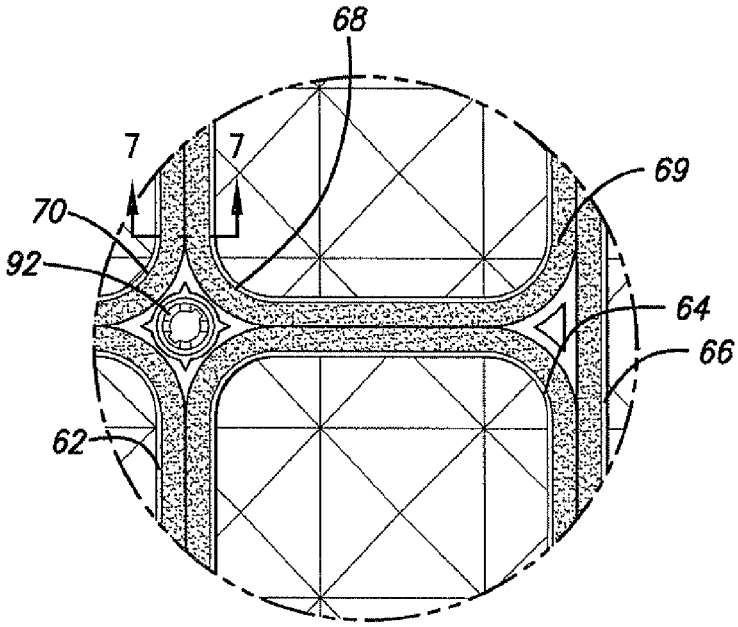
FIG. 5 is a segmented view of a portion of FIG. 4 taken about the lines 5-5 thereof.
Figure 7:
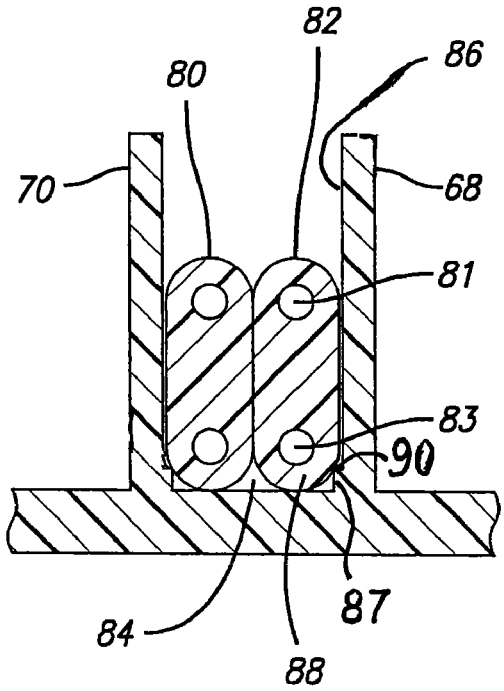
FIG. 7 is a cross-sectional view of a portion of the lid of FIG. 5 taken about the line 7-7 thereof.

Referring more particularly to FIGS. 4, 5 and 7, the lid 40 is illustrated in further detail. As is shown, the downwardly extending ribs define a separate channel surrounding each of them as is illustrated at 69 surrounding rib 68. Disposed within each channel is a ring of resilient material such as the ring of resilient material 74 surrounding the rib 66, the ring of resilient material 76 surrounding the rib 64, the ring of resilient material 78 surrounding the rib 62, the ring of resilient material 80 surrounding the rib 70 and the ring of resilient material 82 surrounding the rib 68. It should be noted that in the instances where there are opposed walls of adjacent ribs such as those that exist between the ribs 62 and 64, the ribs 64 and 66, the ribs 64 and 68, the ribs 66 and 68, the ribs 68 and 70, and the ribs 62 and 70 there will be two rings of resilient material side by side within the same channel. That is rings of resilient material 76 and 78 both pass through the channel formed between the opposed portions of the ribs 62 and 64. Such is more clearly illustrated in FIG. 7, which shows the rings of resilient material 80 and 82 disposed in the channel 84, which is formed by the opposed walls of the ribs 68 and 70. As is also illustrated in FIG. 7, the rib 68 has an outer surface 86 which has an increased thickness 87 adjacent the inner wall of the lid with this increased thickness defining a shoulder 90. The ring of resilient material 82 rests against the shoulder 90 and through the utilization of the shoulder 90 is disposed around the outer surface of each of the ribs (a similar shoulder 62 through to the adjacent inner wall of the lid), additional pressure is exerted on the resilient material such as at 80 and 82 to further effect a good seal between the discrete compartments. The rings of resilient material may be constructed of any resilient material desired, but preferably are of extruded silicone material having a pair of voids extending therethough as shown at 81 and 83 FIG. 7. As is shown in FIG. 5, where the channels surrounding the ribs 62, 64, 68 and 70 are most closely associated there is provided an opening 92 through the lid 40. This opening is displaced from the periphery of the lid and is generally centrally located on the lid. The opening 92 receives a movable member in the form of a locking member as will be described more fully below.

Figure 6:
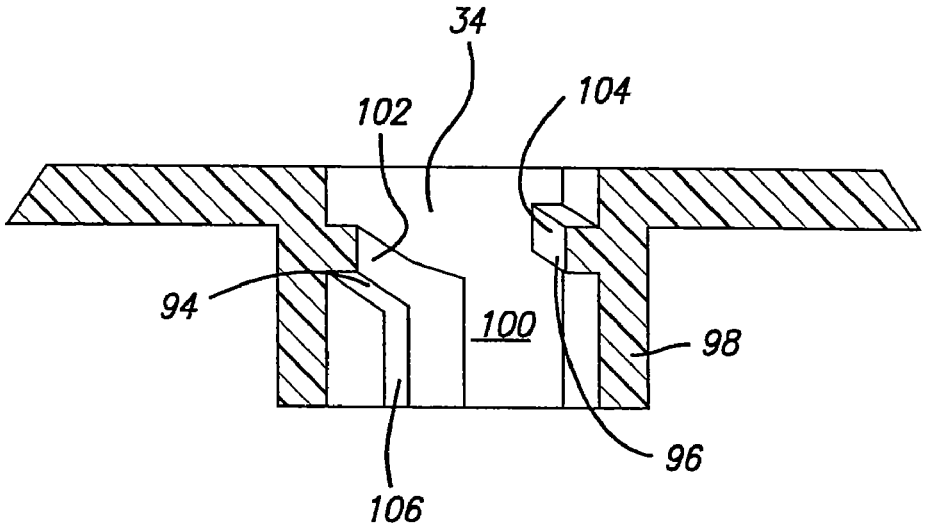
FIG. 6 is a cross-sectional view of a portion of the bottom taken about the lines 6-6 of FIG. 1.

Referring now more particularly to FIG. 6, there is illustrated an inclined plane in two sections as shown at 94 and 96. The inclined plane is formed below at the intersection of the two flat areas 24 and 28 at the opening 34 (FIG. 1). As is shown, there is provided a downwardly extending tubular member 98 having an inner surface 100 with a pair of ridges 102 and 104 extending outwardly therefrom. The inclined planes 94 and 96 are provided on the lower surfaces of those ridge continuing downward to provide a stop surface such as shown at 106 for the inclined plane surface 94. The ridges 104 would be constructed in a similar manner. The function of the inclined planes 94 and 96 and the stop members 106 will be described more in detail herein below.

Figure 8:
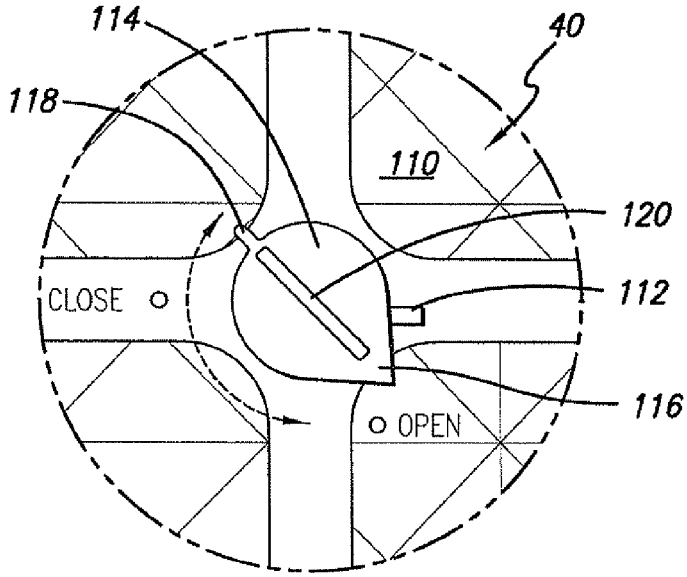
FIG. 8 is a view of a portion of the outside of the lid illustrating a locking mechanism.

As is shown in FIG. 8, to which reference is now made, the lid 40 has an outer surface 110, which has protruding therefrom a stop member 112. Rotatably positioned within the opening 92 (FIG. 5) is a locking member, which is shown as a flange 114 having a generally ogival shape having a vertex 116 and a tab 118 extending from the flange 114 disposed diametrically opposite from the vertex 116. Extending upwardly from the flange 114 is a flat member 120, which may be grasped by the user to rotate the flange 114 between an open position and a closed position as shown on the surface 110 of the lid 40. As is illustrated in FIG. 8 the open position the surface adjacent to vertex 116 interacts with the stop member 112 to preclude further rotation of the flange 114. When rotated in the opposite direction toward the closed position the tab 118 contacts the stop 112 thus further controlling rotation of the flange 114. The remainder of the locking member is illustrated in FIGS. 9, 10 and 11 to which reference is hereby made.

Figure 9:
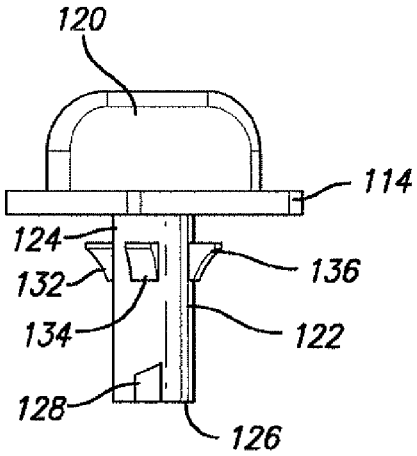
FIG. 9 is a side view of a portion of the locking mechanism shown in FIG. 8.
Figure 10:
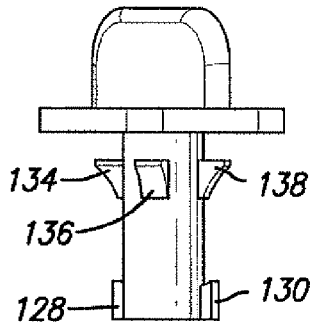
FIG. 10 is a view of the structure of FIG. 9 rotated 90 degrees.

As is shown in FIG. 9, extending downwardly from the flange 114 is a rod 122 having a first end 124 and a second end 126. As is illustrated the flange 114 is connected to the first end 124 of the rod 122. Disposed at the second end 126, but displaced therefrom and extending outwardly from the rod 122 is a finger 128 which as shown in FIG. 10 is duplicated on the opposite side of the rod 122 as shown at 130. Adjacent the first end 124, but displaced therefrom is a plurality of protuberances 132, 134, 136 and 138. These protuberances hold the rod in place on the lid 40. At the time of assembly the rod as shown in FIGS. 9 and 10 is inserted into the opening 92 and forced downwardly so that the protuberances 132-138 are forced through the opening and on the opposite side of the outer surface 110 with the lid sandwiched between the top of the protuberances 132-138 and the bottom of the flange 114.

When the lid 40 is placed onto the bottom section 10 the rod 122 enters the opening 34 with the flange in the open position as shown in FIG. 8. When such occurs, the fingers 128, 130 pass downwardly through the opening 34 in the bottom section 10 and are positioned in such a manner that the fingers 128 and 130 are positioned below the inclined planes 94 and 96. When the flange 114 is rotated to the closed positioned the fingers 128 and 130 engage and slide along the inclined plans 94 and 96 and when this occurs, the central section of the lid 40 is urged downwardly toward the flat areas of the rims of the discrete compartments. This downward urging causes the rings of silicone material to be compressed by the flat areas thus compressing them and creating a seal around each of the discrete compartments, which will preclude any intermingling of the contents of the compartments. When the contents of the discrete compartments are emptied the lid may be placed back on the bottom section, but the locking mechanism should not be turned to the close position, but rather left open to prevent permanent setting of the plastic material from which the lid is constructed and to also allow the silicone rings to return to their original position.

Figure 11:
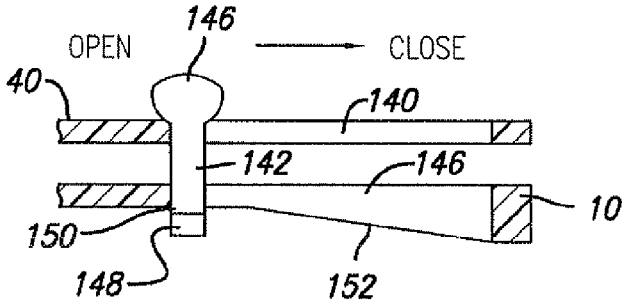
FIG. 11 is a partial view of an alternative locking mechanism.

An alternative locking mechanism is illustrated in FIG. 11. As therein shown, the lid 40 defines an elongated slot or opening 140 therein. A rod or pin like member 142 having a knob 144 or other activating structure extends through the slot 140 into an elongated slot or opening 146 defined by the flat surface 24 (FIG. 1) and extending through the intersection between the flat surfaces 24 and 28. A locking finger 148 extends from the end 150 of the pin 142 and is disposed 90 degrees to the plane of the drawing and engages the inclined plane 152 which extends longitudinally of the bottom section 10. When the pin 142 is moved toward the close position, to the right as viewed in FIG. 11, the finger 148 rides along the surface of the inclined plane 152 and urges the lid 40 toward the top surface of the bottom section 10 to effect the desired seal as above described.

There has thus been disclosed a molded plastic container having a bottom section including a plurality of discrete compartments each of which can be sealed by a lid compressing resilient material. The invention should not be limited to the details shown in the drawings and above described, but determined by the claims appended hereto.

What is claimed is:

1. A molded plastic container for use as a lunch box having a plurality of discrete compartments each of which can be sealed to prevent the contents thereof from spilling or comingling comprising:

a bottom section having a plurality of discrete spaced apart compartments each defined by a continuous wall having an outer surface and an upper rim terminating in a flat area;

a lid having a periphery, an outer surface and an inner wall having a plurality of discrete downwardly extending spaced apart ribs disposed inwardly from said periphery, each of said ribs being dimensioned to be received within said upper rim of one of said plurality of compartments;

a separate channel surrounding each of said spaced apart ribs;

a ring of resilient material disposed in each of said channels;

means disposed on the periphery of said lid for securing said lid to said bottom section to engage said resilient material with said flat areas of said upper rims to seal at least the outer portions of each discrete compartment;

a member in the form of a rod having a fingers extending thererfrom movable between first and second positions extending through an orifice in said lid and disposed inwardly from the periphery and generally centrally thereof;

an inclined plane disposed on said bottom section and positioned to be engaged by said finger on said movable member when said movable member is moved from one of said first and second positions to the other to cause the central portion of said lid to be urged into engagement with said flat areas of said bottom section to thereby compress said resilient material to create said seal in said central portion and remain in that position thereby overcoming any irregularities in said lid;

said rod has first and second ends, an outwardly extending flange as said first end disposed on an outer surface of said lid, said finger being disposed at but displaced from said second end, a plurality of outwardly extending protuberances on said rod and displaced from said flange and engaging the inner wall of said lid to retain said rod in rotatable position in said orifice; and said flange includes a tab extending outwardly therefrom and said outer surface of said lid includes a stop member protruding therefrom, said flange having a generally ogival shape, having a vertex, said tab and said vertex portion of said flange limiting rotation of said rod by engaging said stop member.

* * * * *